United States Patent [19]

Andrews et al.

[11] Patent Number: 4,630,064

[45] Date of Patent: Dec. 16, 1986

[54] SPIRAL ANTENNA WITH SELECTABLE IMPEDANCE

[75] Inventors: George S. Andrews, Kent; Thomas L. Blakney, Bellevue; Douglas D. Connell, Seattle; Bernard J. Lamberty, Kent; James R. Lee, Seattle, all of Wash.

[73] Assignee: The Boeing Company, Seattle, Wash.

[21] Appl. No.: 537,485

[22] Filed: Sep. 30, 1983

[51] Int. Cl.[4] ..... H01Q 1/36

[52] U.S. Cl. ..... 343/895; 343/153

[58] Field of Search ..... 343/895, 447, 16 M, 343/792.5

[56] References Cited

U.S. PATENT DOCUMENTS

| | | | |
|---|---|---|---|
| 2,856,605 | 10/1958 | Jacobsen | 343/895 |
| 2,958,081 | 10/1960 | Dyson | 343/895 |
| 3,131,394 | 4/1964 | Wheeler | 343/895 |
| 3,188,643 | 6/1965 | Dyson et al. | 343/895 |
| 3,229,293 | 1/1966 | Little et al. | 343/895 |
| 3,344,425 | 9/1967 | Webb | 343/895 |
| 3,381,297 | 4/1968 | Zisler et al. | 343/895 |
| 3,599,220 | 8/1971 | Dempsey | 343/895 |
| 3,717,878 | 2/1973 | Mosko | 343/895 |
| 3,778,839 | 12/1973 | Kovar | 343/895 |
| 3,836,979 | 9/1974 | Kurland et al. | 343/895 |
| 4,243,993 | 1/1981 | Lamberty et al. | 343/895 |

OTHER PUBLICATIONS

Bullock et al., "An Analysis of Wide Band Microwave Monopulse Direction-Finding Techniques," IEEE Trans. on Aerospace and Electronic Systems, vol. AES-7, No. 1, Jan. 1971, pp. 188-203.

Kaiser, IEEE Trans. on Antennas and Prop., vol. AP-15, No. 2, Mar. 1967, pp. 304-305.

*Primary Examiner*—Eli Lieberman

*Assistant Examiner*—Michael C. Wimer

*Attorney, Agent, or Firm*—Christensen, O'Connor, Johnson & Kindness

[57] ABSTRACT

A monopulse spiral antenna system of the type having a minimum of three, interwound spiral arms for multimode, direction of arrival sensing, is disclosed in which the antenna arms are shaped and arranged in an overlapping configuration that allows the interarm impedance of the antenna to be adjusted, substantially independently of other electrical properties of the antenna, for matching of the antenna impedance of a mode forming network while preserving the broadband, directional capabilities of the antenna. Several different embodiments of the impedance adaptive antenna are disclosed including a preferred, eight-arm exponential spiral in which the arms are conductive strips transversely inclined relative to a plane formed by the spiral so that opposed and parallel surfaces of adjacent arm strips create a dominant interarm capacitance that in turn determines the overall input impedance of the antenna. Furthermore, the opposed, proximate surfaces of the strip-shaped arms are dimensioned, spaced and inclined at an angle that adapts the input impedance of the antenna to a value matching that of the mode forming network.

14 Claims, 22 Drawing Figures

Fig. 1a.
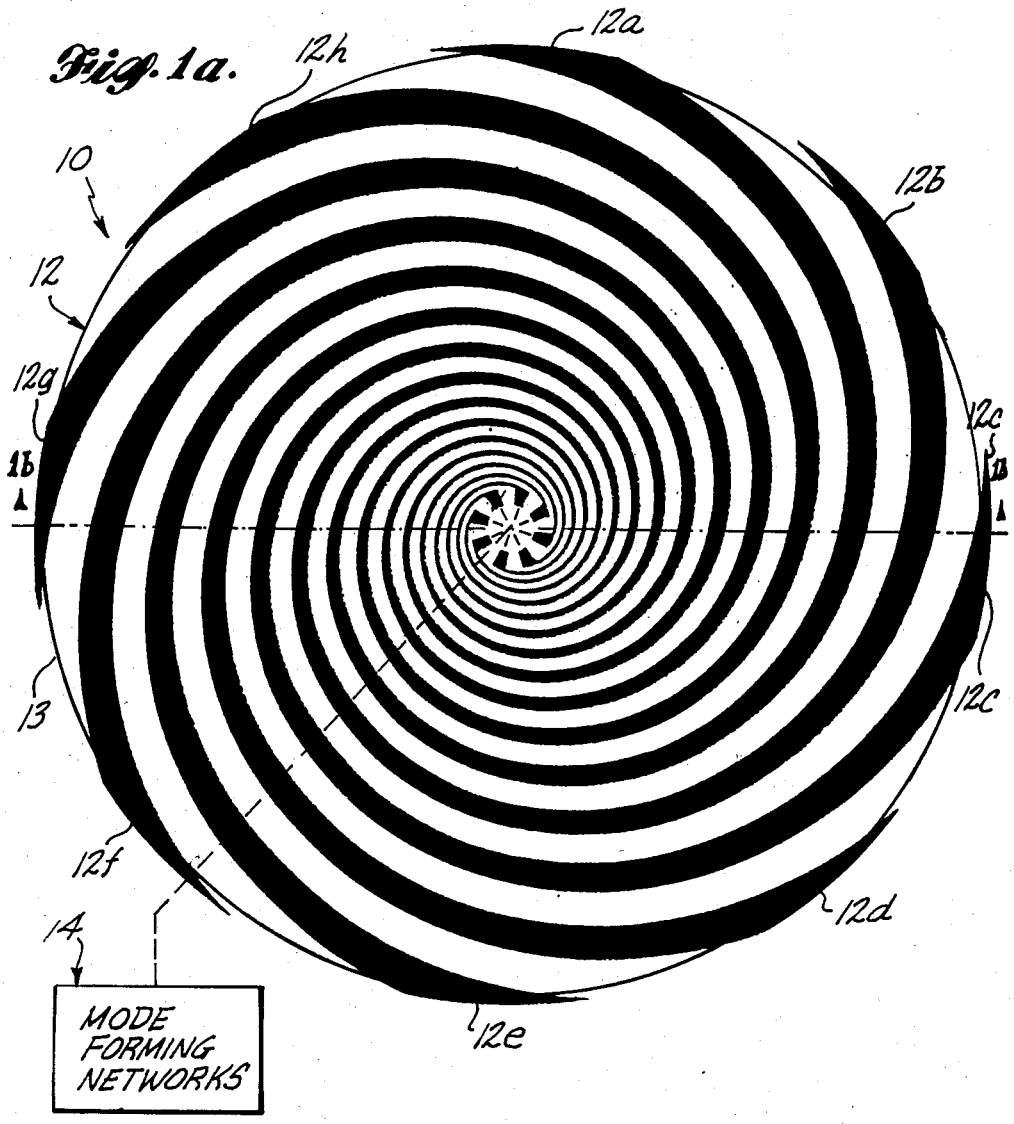
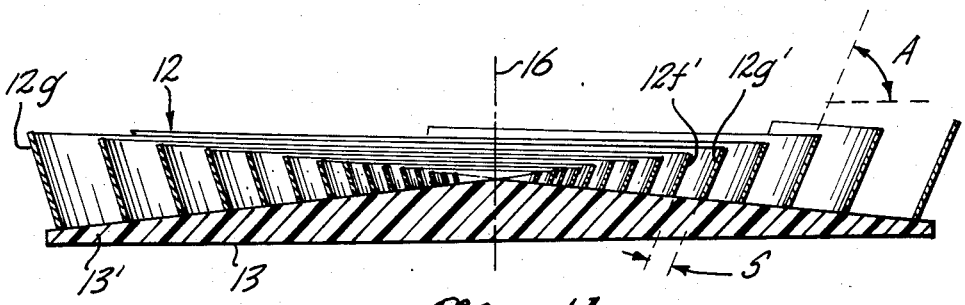
Fig. 1b.

Fig. 6a.
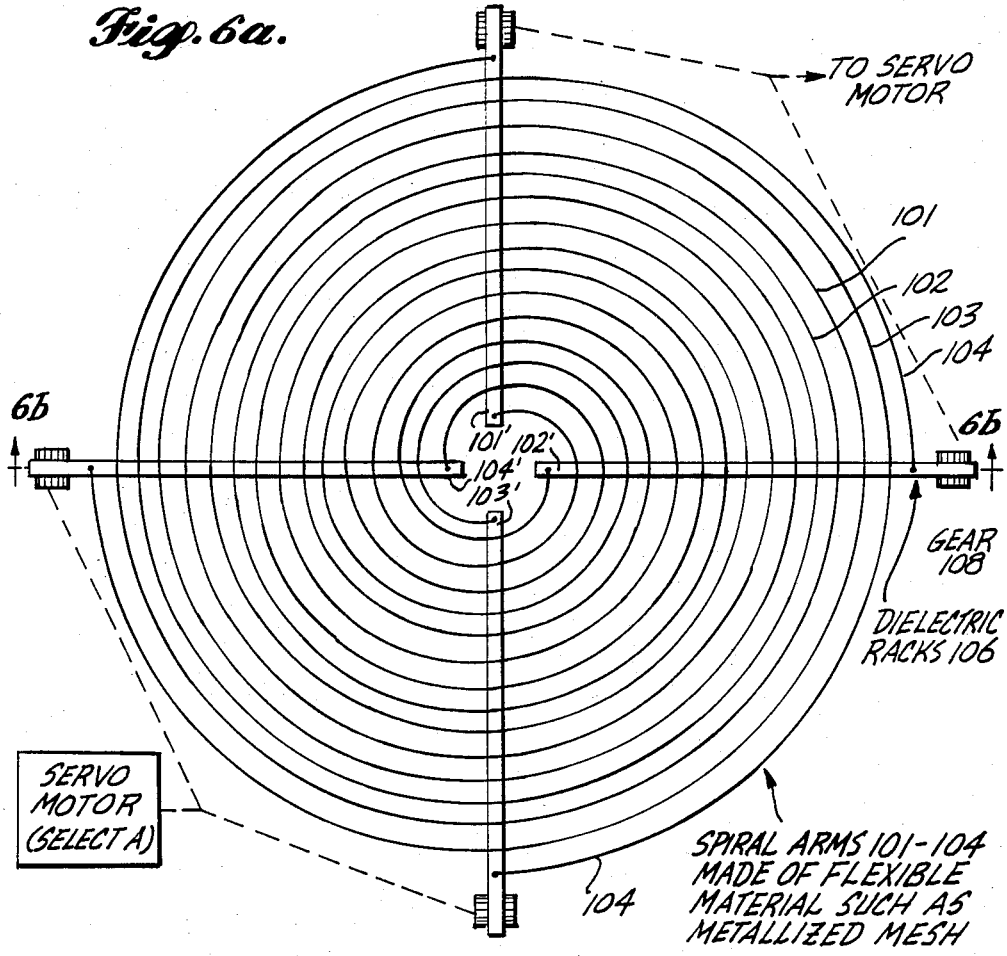
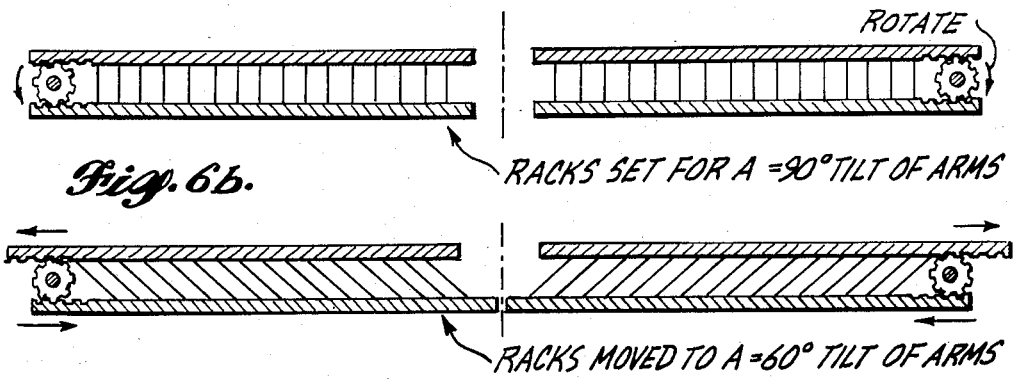
Fig. 6b.
Fig. 6c.

SPIRAL ANTENNA WITH SELECTABLE IMPEDANCE

BACKGROUND OF THE INVENTION

The invention relates to broadband antennas and more particularly to monopulse spiral antennas that are capable of receiving incoming signals over a bandwidth of an octave or more, operating in a plurality of different excitation modes and responding to different senses of polarization.

A primary use of such spiral antennas is for tracking, and specifically angle of arrival (AOA) measurement. For such systems, the antenna is called upon to operate in a plurality of different modes simultaneously or separately, in order to develop sum and difference patterns and/or to selectively receive simultaneously or separately, two different orthogonal senses of polarization. While the antenna configuration is specifically designed to support the different modes of excitation and to receive the different polarizations required for these special circumstances, the feed point impedance of the antenna can differ significantly between modes.

The problem of impedance matching becomes more pronounced as the number of modes and therefore the number of spiral arms is increased. It can be shown that at least three arms are required to provide a single polarization sense set of sum and difference patterns as used in AOA measurement systems. Similarly, at least five arms are required for an orthogonally polarized AOA measurement system. However, an even number of arms are more convenient for interfacing with mode forming networks. So four arm spirals are used for single polarization sense AOA systems and six or eight arm spirals for orthogonal polarization sense AOA measurement systems.

When the number of spiral arms exceeds four, the inherent characteristic impedance of the antenna becomes significantly higher (due in part to a lower interarm capacitance), than the 50 ohms commonly used as characteristic impedance feed lines and as input impedance for mode forming networks. The effect of this increase in the antenna impedance is especially significant when the antenna is operated in the sum beam mode.

While it is possible to design a separate antenna impedance matching device (transformer) to provide a fairly close match to a 50 ohm transmission line for one of its operating modes, the large shift to a different impedance in another antenna operating mode results in a significant impedance mismatch. As a compromise, the transformer may be designed to match the average impedance of the various operating modes to the 50 ohm transmission line and mode forming network impedance. In either case, an impedance transformer is required for each arm of the spiral which can have large insertion losses and can cause phase and amplitude imbalances between arms, especially at higher microwave frequencies if the antenna is designed for multioctave operation.

The difficulty of matching a monopulse spiral antenna impedance to the network mode forming impedance is unique to spiral-type, broadband antennas. Another kind of broadband antenna known as the log periodic monopole array has a configuration which enables its impedance to be adjusted by changing its height over a ground plane. However, the log periodic monopole array has other shortcomings not exhibited in the spiral antennas of the planar and shallow cone angle type, including unequal E- and H-plane patterns and phase center motion as a function of frequency. These characteristics result in uneven sensitivity to incident polarization and illumination, and contribute to defocusing losses when the antenna is used as a feed in a parabolic reflector. For these reasons, the planar and shallow cone angle spiral antennas have been preferred despite the problem in matching the antenna impedance to the mode forming network.

Prior attempts to decrease the impedance of multiarm spiral antennas in order to achieve a better match to the mode forming network have primarily involved the reshaping of the antenna arms by increasing the width of the conductors in the plane or cone of the spiral, and decreasing the edge-to-edge gap separating such conductors. The antennas are constructed with spiral arms lying in a common plane, or on the surface of a cone, and in such a configuration, the interarm capacitance can be increased (and thus the antenna impedance decreased) by enlarging the width of the conductor arms relative to the free space or dielectric gap that exists between adjacent edges of the arms. It has been found however that the impedance of the antenna cannot be sufficiently decreased before insurmountable manufacturing problems are encountered due to impractically small gaps between the conductor arms. Moreover, such small interarm spacing produces inefficient radiation of energy from the antenna.

Broad-band, monopulse spiral antennas of the type discussed above are generally disclosed in U.S. Pat. No. 3,229,293, issued to J. H. Little, et al.; and No. 3,344,425, issued to James E. Webb, administrator NASA. Orthogonally polarized, broadband monopulse antennas are generally disclosed in U.S. Pat. No. 3,681,772 issued to P. Ingerson and No. 4,243,992 issued to B. Lamberty et al.

Also pertinent to the background of the invention is U.S. Pat. No. 2,856,605, issued to E. R. Jacobsen. U.S. Pat. No. 2,856,605 discloses a spiral-type of antenna in which a pair of dipole arms are each formed in the shape of a conductive strip of increasing width as a function of length and interwound so as to create a "distributed capacitance" that is intended to achieve a "substantially mean input impedance" over the bandwidth of the antenna. The purpose and teaching of this inventor are to replace a "lumped" capacitance at the outboard turns of the spiral arms, by a distributed capacitance. The capacitance is uniformly spread over the plurality of turns of the antenna arms and the magnitude of capacitance per wavelength is constant from the center of the antenna to the outermost turns of the spiral elements. Since an N-arm spiral is capable of operating in N-1 independent modes, such a two-arm spiral is not intended for, nor capable of, functioning as a broadband, monopulse antenna system for determining direction of arrival by multimode sum and difference operation or for separately receiving different orthogonal senses of polarization. It is capable of a single mode of operation only ($N=2, N-1=1$ mode), that is, a sum mode, and a single sense of circular polarization only, which corresponds to the wrap direction of the elements. For reasons discussed above, a two-arm spiral antenna is impractical for direction of arrival sensing and multipolar operation.

SUMMARY OF THE INVENTION

In accordance with the invention, it has been discovered that the feed point impedance of a broadband, monopulse spiral antenna system of the type having at least three coaxial, interwound arms suitable for operating in any combination of possible sum and difference modes can be effectively matched to the input impedance of the required mode forming networks by shaping and arranging the conductive arms of the antenna in the following manner. The antenna arms have a dimension each transverse to the arm length which presents conductive surfaces that are opposed, proximate and substantially parallel to adjacent arm surfaces to form interarm capacitance that in turn establishes the overall input impedance of the antenna. This configuration of the antenna arms accommodates adjustments of the opposed arm surfaces for matching the antenna impedance in a specific selected operating mode such as a sum mode. Alternatively, the spiral parameters may be set so the feed point impedance provides an average match over several operating modes to a predetermined mode forming network input impedance.

In a preferred form of the antenna system, the mode forming network includes means for forming the various sum and difference modes of operation simultaneously, and the opposed surfaces of the adjacent arms are shaped, dimensioned and spaced, such as by a dielectric support, so that the antenna, when operated in a sum mode, has an input impedance $Z_s$, and when operated in a first difference mode, has an input impedance $Z_d$, where the average value of $Z_s$ and $Z_d$ approaches the characteristic input impedance $Z_i$ of the mode forming network. Also, in the preferred form of the invention, the antenna comprises eight sprial arms, in which the dimensions of each of the arms and the spacing of the arm surfaces increase at a constant angular rate as a function of increasing angle of revolution about the axis of the antenna. The opposed surfaces of the antenna arms, when viewed in a cutting plane that includes the axis of the antenna, are inclined at an angle A relative to a plane perpendicular to the antenna axis in which angle A is selected to cause the mean or average impedance of the described operating modes of the antenna to approach the impedance $Z_i$ of the mode forming network.

In another embodiment of the invention, the configuration of the arms and the opposed, proximate and parallel surfaces of such arms are oriented perpendicularly to the antenna axis. This configuration is preferred for providing average impedance match to both sum and difference modes where the highest operating frequency is in the high microwave band, since it is the easiest configuration to fabricate while still retaining the controllable impedance aspects of the invention. Furthermore, certain forms of this embodiment, as described later, are preferred for unidirectional applications such as for feeds in reflectors.

It is apparent that these embodiments are only certain examples of a wide range of choices available to the designer. The impedance of any mode or the average impedance of any combination of modes may be matched to the mode forming network impedance by the invention. In another alternative embodiment described herein for use when the desired format of operation is to select from several modes (e.g., a sum mode and difference mode) separately, the angle A of the antenna arms can be adjusted or varied by mechanical means to a different value for each mode, thereby providing a controllable impedance match to the impedance $Z_i$ of the feed network for each mode.

To provide a complete disclosure of the invention, reference is made to the appended drawings and following description of particular and preferred embodiments as well as alternative embodiments.

BRIEF DESCRIPTION OF THE DRAWINGS

FIG. 1*a* shows a preferred embodiment of the monopulse antenna system in which the multiarm spiral antenna is shown in a plan view, and the accompanying networks for mode selection and center feeding of the antenna are shown in block diagram form.

FIG. 1*b* is a cross-sectional view taken along section line 1*b*—1*b* of the plan view of the multiarm spiral antenna shown in FIG. 1*a*.

FIGS. 6*a*, 6*b* and 6*c* are plan and sectional views, respectively, of an alternative embodiment in which the tilt angle A is mechanically variable by a control means in the form of rack and pinions driven by a servo motor.

DETAILED DESCRIPTION

Figure 2:
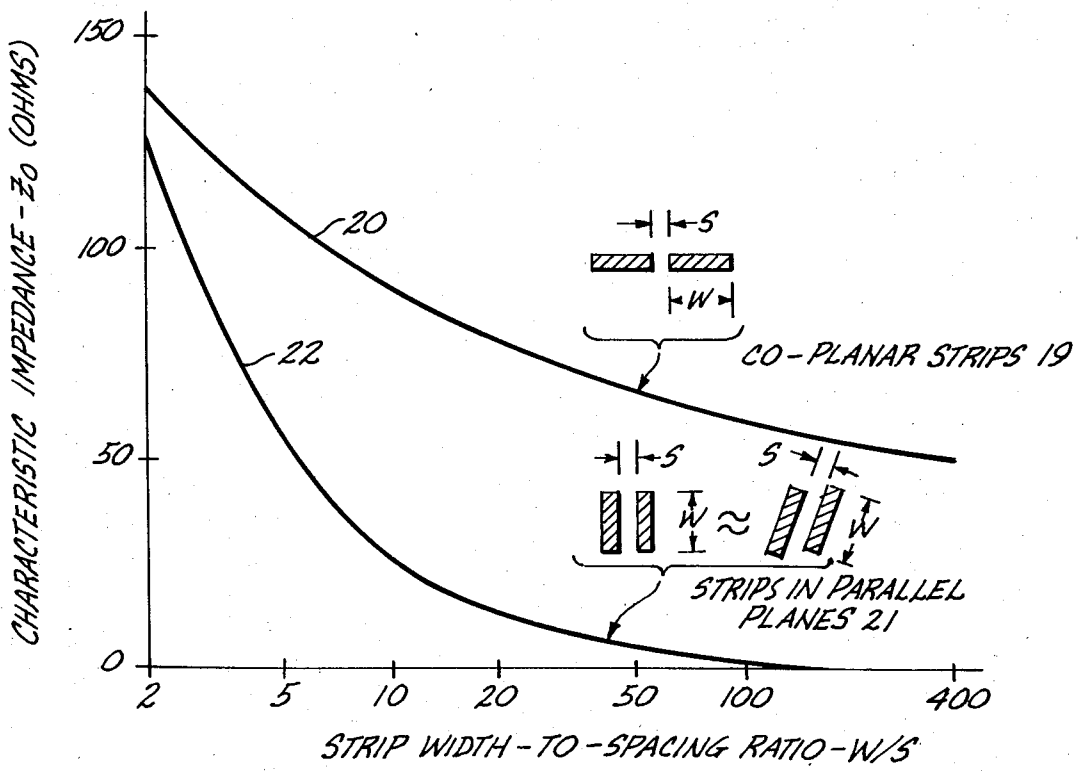
FIG. 2 is a graph showing the impedance versus spacing characteristics of two different configurations of conductive strips including coplanar strips and opposed, parallel strips in which this graph helps illustrate one of the principles upon which the invention is based.

In FIG. 1*a*, a preferred embodiment of the monopulse, multimode directional antenna system 10 is shown to include a multiarm, spiral-type antenna 12, having its conductive, spiral arms 12*a*–12*h* shaped and arranged to form interarm capacitance that is adaptive to a predetermined feed impedance of mode select and center-feed networks 14. In this embodiment, the eight spiral arms 12*a*–12*h* are shaped and arranged in a transversely inclined manner like the blades of a turbine, as best seen in the cross section of FIG. 1*b*, and are supported in this arrangement by dielectric support 13. Unlike existing monopulse, multimode spiral antennas, the conductive arms have opposed, proximate and parallel surfaces to create a predominating interarm capacitance that can be adjusted in magnitude by the width, spacing and angular degree of tilting of the turbine-blade-like conductive arms. In comparison, a conventional monopulse spiral has antenna arms which lie on a common plane or conical surface, such that the dominate factor influencing capacitance is the arm width and edge-to-edge proximity of the flat arms. As mentioned above, this gap between the arm edges limits, as a practical matter, the magnitude and range of capacitance that can be achieved.

While the opposed, proximate and parallel surfaces of the inclined antenna arms create a significant and adjustable capacitance that enables the antenna impedance to be matched to the input impedance of the mode forming network, such configuration does not substantially alter the fundamental gain patterns of such antenna systems which enable direction finding and selective reception of different senses of polarization. The basic operation of antenna systems of this type is well known. Briefly, to function in a monopulse, multimode directional antenna system, antenna 12 must include at least three spiral arms, and preferably four to eight such arms are provided. Less than three spiral arms fails to provide an adequate number of modes required to generate angle of arrival resolution. The preferred four-to-eight arm spiral antenna is combined with a mode forming network. For example, a common arrangement includes a mode forming network having two receiving channels. The antenna is simultaneously or alternately operated in a sum mode and a difference mode. The phase and amplitude of received signals in these two modes are amplified in the two receiving channels and compared so as to develop two-dimensional bearing information. In both the sum and difference modes, the gain lobes of the antenna are represented by surfaces of revolution symmetrical about the antenna axis (bore sight axis) of the spiral antenna. The sum operating mode is characterized by a radiation distribution pattern (lobe) in the shape of a single, generally egg-shaped pattern, centered about the antenna axis and having a gain maximum on the axis. The difference mode has a pattern (lobe) that is generally annular in configuration, also symmetrical with the antenna axis, but with the maximum gain offset from the axis and a gain minimum on the axis. These antenna modes can be used simultaneously, or alternately, and the phase and amplitude of incoming signals will be differentially received by these antenna modes because of the difference in the gain patterns. By comparing the amplitude and phase of signals received in the different modes, directional information is derived.

As shown in FIGS. 1*a* and 1*b*, spiral arms 12*a*–12*h* are each in the form of elongated strips of conductive material, usually a highly conductive metal such as copper, gold, aluminum, silver or an alloy of these metals, and having a width and spacing that increases as a function of angular rotation about antenna axis 16. The spiral of any given arm may include more than one full revolution about axis 16. For example, in this case, each of the arms spirals outwardly from the center of the antenna approximately $1\frac{3}{4}$ of a revolution. Furthermore, the spiral of each arm is of equiangular configuration, increasing in radially outward spacing from the center of the antenna as a function of angle of revolution. Such an equiangular spiral antenna has certain, predictable electrical properties which have been found useful when operated in multimodes as a direction finder. The equiangular spiral format is also sometimes referred to as an exponential or log spiral. The dielectric between the arm surfaces in this embodiment is air, but can be a different dielectric material depending on the application.

In accordance with the selectable impedance configuration of arms 12*a*–12*h* of antenna 12, the transverse dimension of each arm is tilted so as to not lie in a common plane with the spiral (or on the surface of a cone, in the case of a conical spiral antenna), but rather to be inclined at an angle A relative to such a common plane or cone surface. The tilting of the transverse dimension of the various arm strips, as best shown in FIG. 1*b*, disposes the strip surfaces in generally opposed, proximate and parallel relation as illustrated by surfaces 12*f'* and 12*g'* of arms 12*f* and 12*g*, respectively. The proximity of surfaces 12*f'* and 12*g'* is established by a separation S measured generally normal to the surfaces, and increases with the increasing radial portion of the arms in an equiangular fashion, beginning with the smallest spacing $S_i$ to the largest spacing $S_o$.

The dielectric support 13 for antenna 12 may be of any suitable dielectric material commonly used in antenna systems. In this embodiment, the lowermost edges of spiral arms 12*a*–12*h* are affixed to the surface of a supporting conical surface 13' having a slight upwardly facing pitch. Alternatively, antenna arms 12*a*–12*h* may be constructed so that the lowermost or uppermost edges of the spiral arms lie in a common plane and in such case the dielectric support surface could be flat as illustrated in the embodiment of FIG. 4*i*.

The substantial surface areas of the various arms in the opposed, proximate and parallel relationship described and shown, produce a significantly increased interarm capacitance in the multiarm spiral antenna, and hence a lower overall antenna impedance. Furthermore, the interarm spacing S of the opposed surfaces, the tilting angle A, the amount of directly opposing surface area of the arms and the interarm dielectric (here being air) can be varied within a wide range of specifications to adapt the antenna impedance to a value typical of commonly used feed networks, transmission lines and structures, such as 50 ohm. Most importantly, these parameters may be varied to adapt the antenna impedance to a value that substantially matches the mode forming network impedance to a single mode, when the antenna is operated in different modes, including the sum and difference modes required for direction finding or may be set to a value that matches the mean of the impedance of the several modes when the modes are operated simultaneously. In adjusting the tilt angle A, the fundamental electrical properties of the antenna as a monopulse, multimode directional system are not significantly altered, only the impedance of the antenna is adapted for efficiently transferring electrical energy between the antenna and the mode forming networks 14.

The equiangular spiral construction of antenna 12 having arms 12*a*–12*h* that spiral outwardly with progressively increasing interarm separation, creates an antenna with unique properties not available in other types of spiral antennas such as an Archemedian spiral in which the interarm separation remains constant with radius. The equiangular (or as it is sometimes called exponential or log spiral) exhibits a more uniform gain over a wider bandwidth of frequencies, which can encompass an octave or more. This wide bandwidth operation is associated with an antenna characteristic in which different annular regions of the spiral become active (excited) as the frequency changes. More specifically, the highest frequencies of the equiangular spiral excite annular regions of antenna 12 that lie closest to the antenna axis 16. As the frequency decreases, different annular regions of progressively larger radius are excited. Accordingly, the lowest frequencies within the antenna bandwidth excite the portion of the spiral arms 12*a*–12*h* that lie at the radially outermost annular regions of the antenna, and have the largest interarm spacing $S_o$. While the radially increasing, interarm spacing of the antenna arms is necessary to create the desirable gain and bandwidth characteristics of the antenna, the different amounts of spacing between the antenna arms as a function of radius do not cause a variation in the antenna impedance as a function of operating frequency.

In accordance with the preferred embodiment of antenna 12 shown in FIGS. 1*a*, 1*b*, the transversely inclined strip conductors that serve as arms 12*a*–12*h* and which determine antenna impedance, are formed with an increasing transverse dimension (strip width) as a function of length so that the ratio of strip width to spacing S remains constant, keeping the capacitance constant with radius. In other words, as the interarm spacing increases with radius tending to decrease the capacitance, a countervailing increasing capacitance effect occurs due to the larger width of the arm strips. The net effect is to leave the capacitance and hence antenna impedance relatively uniform with antenna radius and thus with operating frequency. This constraint on the configuration of arms 12*a*–12*h* is unique to the equiangular spiral. As will be seen herein, an Archemedian spiral, having a constant interarm spacing as a function of increasing radius, requires that the transverse dimension (width) of the arm strips, remain substantially constant with length so as to maintain a uniform impedance as a function of operating frequency.

The effectiveness of the above-described configuration of spiral arms 12*a*–12*h* as an impedance adaptive device can be better understood by referring to a comparison of the electrical impedance characteristics of two different kinds of strip transmission lines as depicted in the graph of FIG. 2. In that figure, two different transmission line geometries are shown: a transmission line consisting of coplanar, spaced strips 19 illustrated in the upper part of the graph, and a transmission line formed of spaced, parallel strips 21 arranged in opposed proximity in parallel planes, as depicted in the lower part of the graph. The plotted impedance characteristic $Z_o$ (differential mode) as a function of strip width (W) to spacing (S) ratio (W/S) shows that the strip in parallel planes (face-to-face) provide a significantly larger range of available impedance values and permit an effectively lower characteristic impedance than possible from a transmission line having coplanar strips (edge-to-edge). Specifically, the upper plotted curve 20 corresponding to the transmission line formed of coplanar strips 19 (detail in cross section) shows an impedance $Z_o$ that varies between approximately 140 ohms at a small width to spacing ratio W/S and decreases asymptotically to an impedance level somewhat above 50 ohms at a width to spacing ratio W/S in excess of 400.

By contrast, the plot shown by curve 22 for strips 21 in parallel planes commences at nearly the same maximum impedance of 125 ohms and decreases sharply down to impedance levels well below 50 ohms for practical width to spacing ratios in the range of W/S=5 to 50. The plotted impedance versus ratio W/S shown by curve 22 is for strips of a transmission line in exactly opposed registration (no transverse offset), however, the plotted characteristics closely approximate, and are valid for, the related configuration of strips in parallel planes but transversely offset as depicted in the detail of FIG. 2. The degree of transverse offset changes the impedance characteristics by shifting curve 22 toward curve 20 as the offset increases. Note that the strips in parallel planes with the transverse offset are very similar to the geometry of the parallel, opposed and proximate surfaces of the transversely inclined spiral arms 12*a*–12*h* shown in the cross section of FIG. 1*b*. Tests have demonstrated that the impedance characteristics expected from the plotted curves 20 and 22 of FIG. 2 based on the strip line analogies to the spiral arms of antenna 12, bear out the theory that the impedance of antenna 12 can be reduced significantly, and controlled for impedance matching purposes, far more readily than previous equiangular spiral antennas having the arms arranged in a common plane or on a common conical surface. In the plotted impedance characteristics of FIG. 2, the values given were based on coplanar strips and strips in parallel planes associated with a dielectric substrate of polytetrafluoroethylene (Teflon-a trademark).

In comparing the plotted curves 20 and 22 of FIG. 2 with the configuration of antenna 12 shown in FIGS. 1*a* and 1*b*, it is observed that the strips 21 in parallel planes (corresponding to curve 22 of FIG. 2) achieve a characteristic impedance of $Z_o$ equal to 50 ohms with a moderate width to spacing ratio W/S equal to about 5. This would correspond to a configuration of arms 12*a*–12*h* in the antenna 12 of FIG. 1*a* and 1*b* in which the angle of inclination A of the arm strips is equal to 90°. In comparison, the coplanar strips (corresponding to plotted curve 20 of FIG. 2) achieve a characteristic impedance of $Z_o$ equal 50 ohms only when the width to spacing ratio W/S exceeds 400, a ratio which is very difficult to achieve in practice, and which produces undesirable radiation characteristics.

Although the foregoing study is based on differential-mode excitation of a two conductor strip transmission line of infinite length, compared to the arms 12*a*–12*h* of antenna 12 which have finite length, are curved in the spiral pattern and are excited in a combination of even and odd modes, these differences do not detract from the analogy and tests on actual antenna configurations have confirmed the above stated conclusions. These conclusions are that a practical input impedance, and moreover an impedance that is readily selected or adjusted to a predetermined impedance of mode forming networks 14 is achieved by the arrangement of strip arms 12*a*–12*h* so that they do not lie entirely within a common plane or on a common conical surface, but rather have at least partial face-to-face orientation for increased interarm capacitance.

Figure 3A:
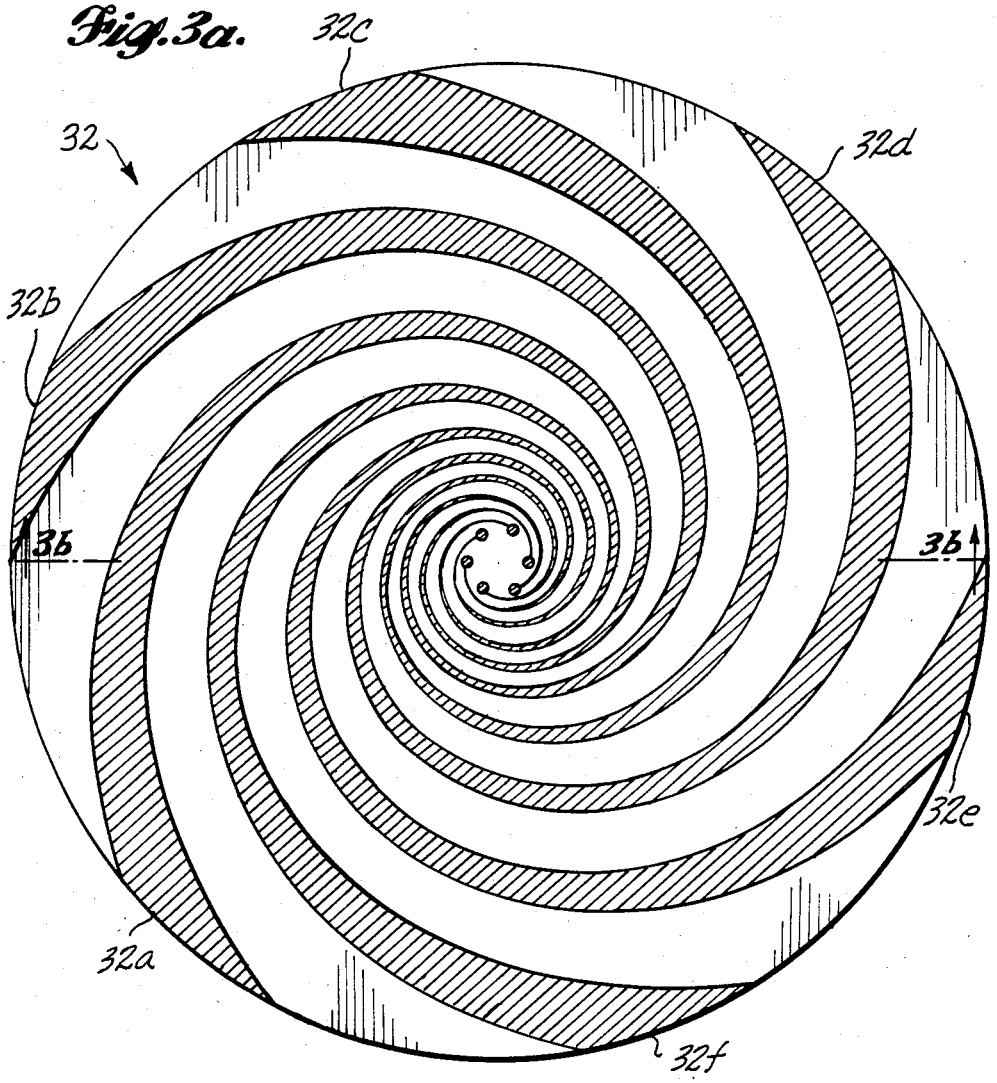
FIG. 3*a* is a plan view of an alternative embodiment of a multiarm spiral antenna of the invention, similar to the view in FIG. 1*a*.
Figure 3B:
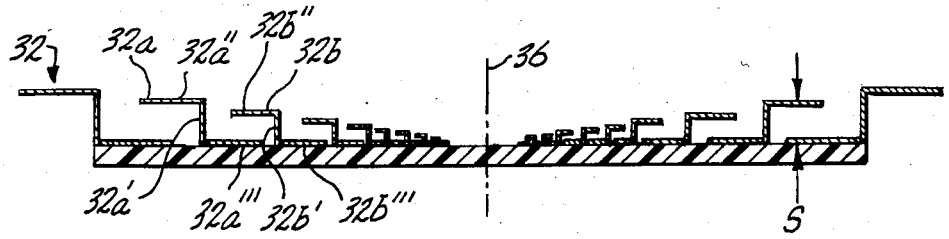
FIG. 3*b* is a cross-sectional view taken along section line 3*b*—3*b* of the plan view in FIG. 3*a*.

With reference to FIGS. 3*a* and 3*b*, an alternative embodiment of the invention is shown in which an equiangular spiral antenna 32 is shown having a plurality of spiraling arms (six in this example) 32*a*, 32*b*, 32*c*, 32*d*, 32*e*, and 32*f*. In this case, each of the spiral arms has a cross sectional shape as shown in FIG. 3*b* which with reference to arm 32*a* includes a center strip portion 32*a*′ which is parallel to the antenna axis 36, and inwardly and outwardly radially projecting flange strip portions 32*a*″ and 32*a*‴. The interarm capacitance that dominates the impedance of antenna 32 is that which is created between the opposing flange surfaces that lie in radial planes perpendicular to axis 36, e.g., between the upwardly facing surface of strip portion 32*a*‴ of arm 32*a* and the downwardly facing surface of flange portion 32*b*″ of arm 32*b*. The gap or separations of these opposing surfaces is selected to be substantially less than the spacing of central strip portions 32*a*′ and 32*b*′ which are parallel to axis 36. Hence, portions 32*a*′ and 32*b*′ contribute only a small fraction of the interarm capacitance that determines the antenna impedance. The electrical antenna properties, apart from the adaptive impedance for matching purposes, exhibits multimode gain patterns similar to the spiral antenna 12 of FIGS. 1*a* and 1*b*.

Figure 4A:
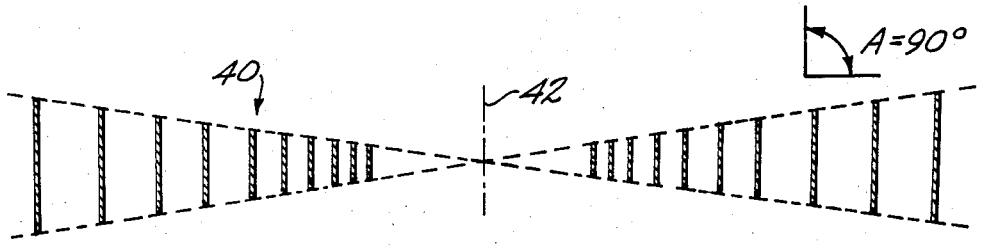
FIGS. 4*a*, 4*b*, 4*c*, 4*d*, 4*e*, 4*f*, 4*g*, 4*h*, 4*i*, 4*j* and 4*k* are simplified schematic cross-sectional views of further alternative embodiments of the monopulse, multiarm spiral antenna of the invention, shown in a view similar to FIG. 1*b*.
Figure 4B:
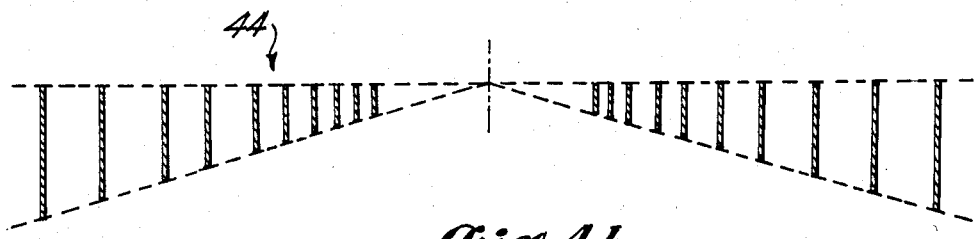
Figure 4C:
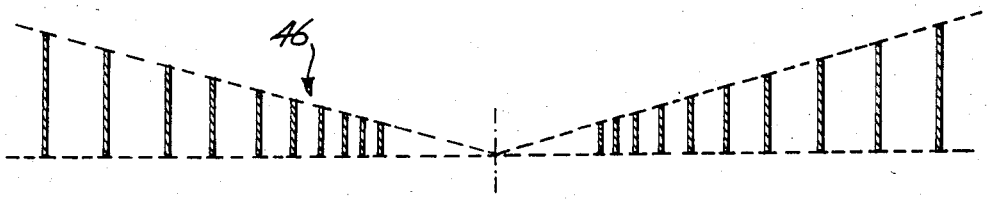
Figure 4D:
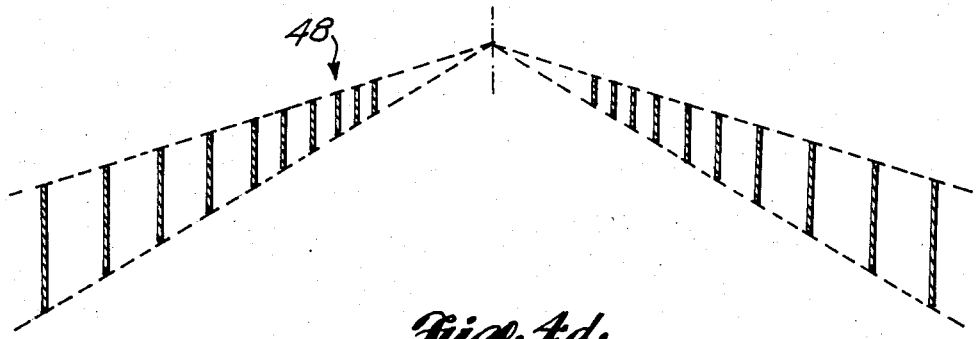
Figure 4E:
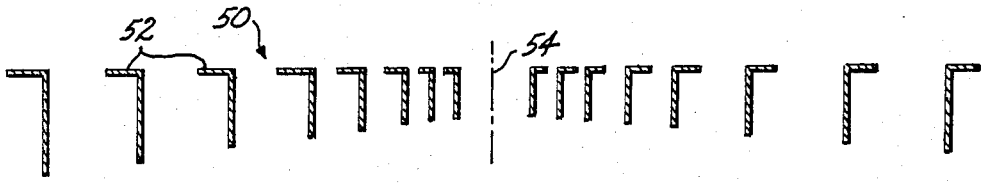
Figure 4F:
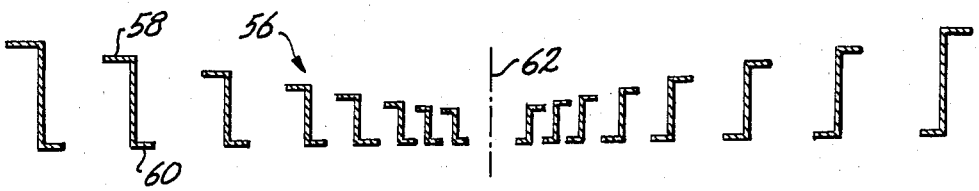
Figure 4G:
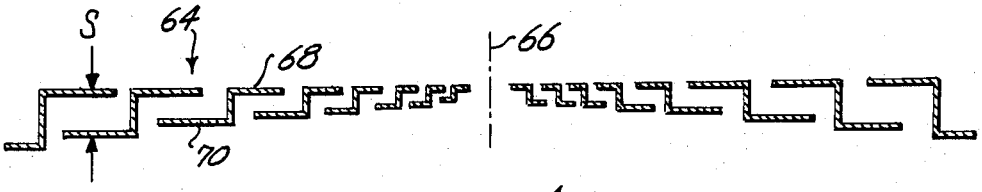
Figure 4H:
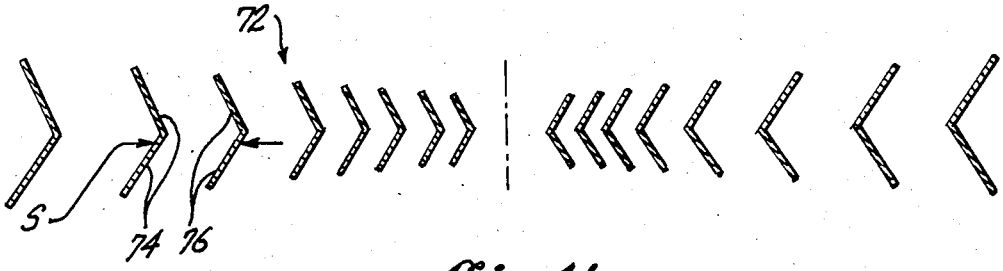
Figure 4I:
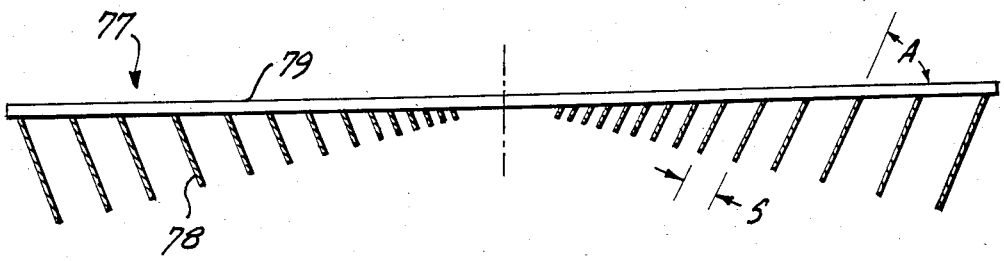

With references to FIGS. 4*a*–4*k* alternative embodiments of the invention are shown in a series of equiangular spiral antennas schematically depicted in a form of a simplified cross section similar to FIGS. 1*b* and 3*b*. In FIG. 4*a*, an antenna 40 is shown to comprise a plurality of spiral arms in which the strip width of each of the various arms is disposed at an angle A=90° relative to a plane perpendicular to the antenna axis 42, and the upper and lower edges of the arm strips are disposed to define oppositely pitched conical surfaces. In FIGS. 4*b*, antenna 44 is similar to the equiangular spiral antenna 40 of FIG. 4*a* except that the uppermost edges of the arm strips lie in a common plane, while the lowermost edges of these strips define a conical surface. In FIG. 4*c*, antenna 46 is similar to antenna 44 except that the lower edges of the arm strips are in a common plane while the upper edges define a conical surface. In FIG. 4*d*, antenna 48 is similar to antennas 44 and 46 of FIGS. 4*b* and 4*c* respectively, except that in FIG. 4*d* both the upper and lower edges of the strip-shaped arms form conical surfaces of the same sense but of different degrees of pitch. In tests of an eight arm embodiment of the configuration shown in FIGS. 4*b* and 4*c*, it was demonstrated that the sum mode and first difference mode input impedances were 50 ohms and 25 ohms respectively, compared to the corresponding input impedances of the 8-arm planar spiral counterpart' of 170 ohms and 85 ohms respectively. Furthermore, it has been discovered that the forms of this configuration shown in FIGS. 4*b* and 4*c* have another advantageous feature, namely a preferred direction of radiation or reception. The antenna pattern of a conventional, flat, multiarm spiral is bidirectional, that is, identical on each side of the spiral. This can be a detriment when such a spiral is used as a feed in a reflector antenna. The half of the pattern pointing away from the reflector must either be attenuated by an absorber, thereby reducing antenna efficiency in half, or reflected by a metal ground plane back to the reflector, thereby reducing the useful bandwidth. In this alternate configuration, shown in FIG. 4*b*, the antenna pattern tends to be unidirectional where the preferential direction is normal to and away from the flat face of the spiral (upward direction in the figure). The gain of this configuration is significantly higher than that of a conventional, bidirectional flat spiral. Thus, it will also have a much higher efficiency than that of a flat spiral with an absorbing ground plane. This tendency to produce a unidirectional pattern is expected to prevail in all configurations with a flat surface, including those of FIGS. 3*b*, 4*b*, 4*c*, 4*e*, 4*f* and 4*i*.

In FIG. 4*e*, antenna 50 is of an equiangular spiral type similar to antenna 44 of FIG. 4*b* but modified to include radially outwardly projecting flange portions 52 joined at right angles to the upper edges of the arm strips, all in a common plane perpendicular to the antenna axis 54. In FIG. 4*f*, antenna 56 has oppositely projecting radial flanges 58 and 60 respectively joining the upper edges of the arm strips which define a conical surface, and the lower edges of the same strips which lie in a common plane perpendicular to antenna axis 62. In FIG. 4*g*, antenna 64 is a variation of antenna 56 of FIG. 4*f*, in which the width of the arm strips that are parallel to the antenna axis 66 are compressed along the axis and the oppositely projecting flanges 68 and 70 at the upper and lower edges of the central portion of the arm strips are accentuated in the radial planes so that the predominant capacitance effect occurs between the opposing surfaces that lie in such radial planes as represented by the capacitance determining gap S. It is thus seen that antenna 64 in FIG. 4*g* is similar to the above-described spiral antenna 32 in FIGS. 3*a* and 3*b* except that antenna 64 has the upper edge flanges 68 disposed in a common plane and has the lower edge flanges 70 projecting from edges of the antenna arm strips that define a conical surface.

In FIG. 4*h* an antenna 72 of the equiangular spiral type has arms which in transverse section appear as adjoining, oppositely oriented diagonal lines, in this instance projecting radially outwardly both diagonally upwardly and diagonally downwardly such that the capacitance affect is achieved between the radially opposing and parallel surfaces 74 and 76 separated by the gap S.

In FIG. 4*i*, antenna 77 is similar to the antenna 12 shown in FIGS. 1*a* and 1*b* except that one set of edges of spiral arms 78 lie in a common plane (upper edges) and a flat dielectric support 79 is fastened to these arm edges.

Figure 4J:
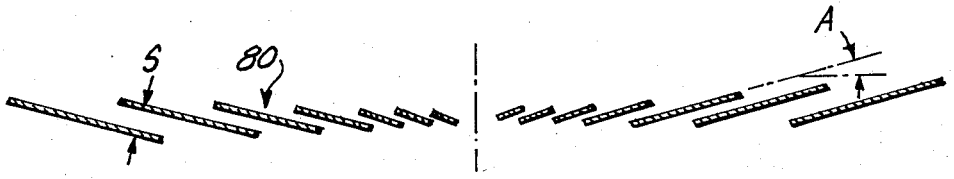

In FIG. 4*j*, an antenna 80 is of an equiangular spiral type in which the strip arms are inclined in a radially and upwardly oriented pattern similar to antenna 12 of FIGS. 1*a* and 1*b* but at a minimal angle A of inclination. The adaptability of the antenna impedance is demonstrated by comparison of the configurations of antenna 12 in FIGS. 1*a*–1*b* and antenna 80 in FIG. 4*i*.

Figure 4K:
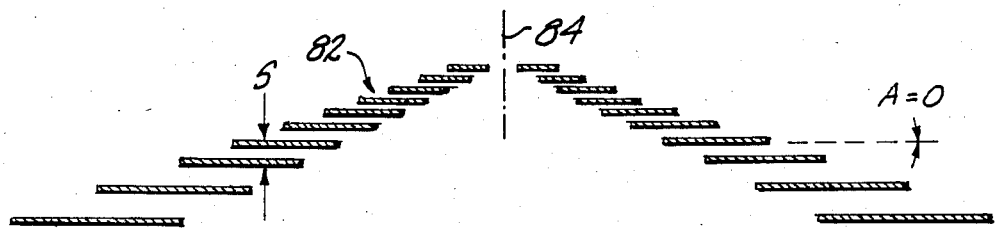

In FIG. 4*k*, the strip-shaped arms 82 are arranged in the form of helices in which the individual arm surfaces have a slight pitch but are nearly perpendicular to the antenna axis 84. The capacitance of the antenna arms is thus determined by the separation S existing between the parallel surfaces of the antenna arms that lie in the nearly parallel planes perpendicular to axis 84. It is observed that antenna 82 represents the limit of decreasing the angle of arm inclination A to zero. This embodiment is expected to provide a unidirectional pattern toward the top of the page (toward the apex of the cone) and so will have higher gain than a flat spiral.

Figure 5A:
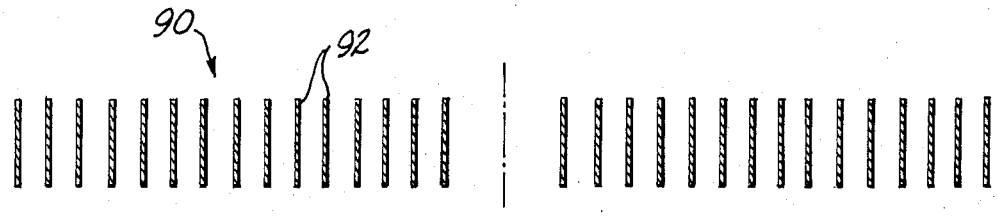
FIGS. 5*a*, 5*b*, and 5*c* are simplified cross-sectional views of other, alternative embodiments of the monopulse, multiarm spiral antenna, shown in views corresponding to FIG. 1*b*.
Figure 5B:
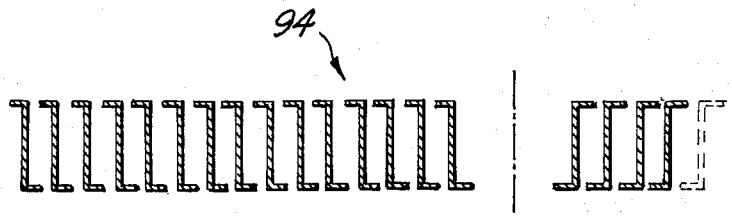
Figure 5C:
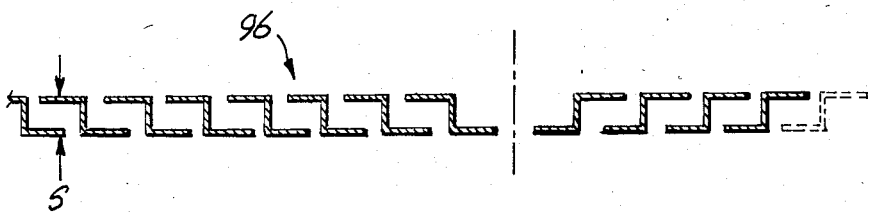

With reference to FIGS. 5*a*–5*c*, embodiments of the variable impedance spiral antenna are shown in an Archemedian array. Thus, in FIG. 5*a*, antenna 90 is formed by a plurality of interwound arm strips 92 arranged at equal radial spacing and being of substantially equal width (equal transverse dimension) as depicted in the cross-sectional representation of the drawing. With equal widths of strips 92, there is not the progressive increase in the strip width from the radially innermost to radially outermost windings of the arm spiral. In contrast to the equiangular spiral antenna embodiment discussed above, the constant radial spacing of the arm strips 92 requires an opposing surface area on the arms that is uniform with radius in order to maintain the capacitance between the arms uniform with antenna radius. Similarly with reference to FIG. 5*b*, another Archemedian version of the antenna in accordance with the invention is shown in which antenna 94 has oppositely projecting radial flanges at the upper and lower edges of the strips that form the spiral arms. In FIG. 5*c*, antenna 96 is similar to the Archemedian antenna 94 except that the central strip portion of the antenna arms is compressed along the axis of the antenna such that the capacitance between the arms is determined primarily by the gap S between the flange surfaces of the arms which lie in the radial planes. The archemedian embodiments are easier to fabricate than equivalent equiangular embodiments when the intended use is in high microwave frequency bands.

FIG. 6*a* shows a variable tilt (variable angle A) version of the multiarm spiral as implimented on an archemedian spiral configuration. In this embodiment the spiral arms 101–104 are constructed of flexible conductive material such as metalized mesh and suspended between four dielectric racks 106 arranged radially. Gears 108 are inserted between the pairs of racks 106 and are driven in response to a signal command (setting of tilt A) by servo motor 110.

Where the gears are rotated, the upper racks (see FIGS. 6*b* and 6*c*) are displaced radially in an appropriate direction from the lower racks thus changing the angle "A" of the spiral arms 101–104 from 90° shown in FIG. 6*b* to about 60° shown in FIG. 6C and, thus, also changing the antenna impedance. A wide range of values of tilt angle A, and of impedances is available using this embodiment. The embodiment is shown for illustration only and the invention is not limited to a rack and gear mechanism or to achemedian spirals. Other control means of varying angle A using this principle will be apparent.

While only particular embodiments have been disclosed herein, it will be readily apparent to persons skilled in the art that numerous changes and modifications can be made thereto including the use of equivalent devices and method steps without departing from the spirit of the invention.

The embodiments of the invention in which an exclusive property or privilege is claimed are as follows:

1. A monopulse antenna system comprising a multiarm spiral antenna having at least three spiral arms arranged in a coaxial, interwound array so as to define an antenna axis, and a mode forming network having a predetermined feed impedance $Z_i$ coupled to a feed input of the antenna at the innermost ends of said arms, each of said arms including at least two noncoplanar surface regions that are opposed, proximate and generally parallel to surface regions of radially inward and radially outward adjacent arms such that the opposed, proximate and parallel surface regions of such adjacent arms form an inter-arm capacitance which in part determines the input impedance Z to said antenna, said arm surface regions being dimensioned and spaced in said opposed, proximate and generally parallel relationship such that said inter-arm capacitance is substantially constant with radius from the innermost ends to the outermost ends of said arms, and so as to cause the input impedance Z of the antenna to assume a value that approaches said predetermined impedance $Z_i$ of said mode forming network.

2. The antenna system of claim 1, wherein said mode forming network has a sum mode and a difference mode of operation of said antenna, and said antenna, when operated in said sum mode, has an input impedance $Z_s$ and said antenna, when operated in said difference mode, has an input impedance $Z_d$, and wherein said arm surface regions are dimensioned and spaced in said opposed, proximate and parallel relationship so that the input impedances $Z_s$ and $Z_d$ approach said feed network impedance $Z_i$.

3. The antenna system of claim 1, wherein said mode forming network has a sum mode and a difference mode of operation of said antenna, and said antenna, when operated in said sum mode, has an input impedance $Z_s$ and said antenna, when operated in said difference mode, has an input impedance $Z_d$, and said arm surface regions are dimensioned and spaced in said opposed, proximate and parallel relationship so that the average of input impedances $Z_s$ and $Z_d$ approaches said feed network impedance $Z_i$.

4. The antenna system of claim 1, wherein said mode forming network has a sum mode and a difference mode of operation of said antenna, and said antenna, when operated in said sum mode, has an input impedance $Z_s$ and said antenna, when operated in said difference mode, has an input impedance $Z_d$, and said arm surface regions are dimensioned and spaced in said opposed, proximate and parallel relationship so that the input impedance $Z_s$ approaches said feed network impedance $Z_i$.

5. The antenna system of claim 1, wherein said mode forming network has a sum mode and a difference mode of operation of said antenna, and said antenna, when operated in said sum mode, has an input impedance $Z_s$ and said antenna, when operated in said difference mode, has an input impedance $Z_d$, and said arm surface regions are dimensioned and spaced in said opposed, proximate and parallel relationship so that the input impedance $Z_d$ approaches said feed network impedance $Z_i$.

6. The antenna system of claim 1, wherein said antenna comprises eight of said spiral arms.

7. The antenna system of claim 1, wherein said surface regions of said arms, when viewed in a cutting plane that includes said antenna axis, include a first transverse surface region that is substantially parallel to said antenna axis and a second transverse surface region that is substantially orthogonal to said antenna axis.

8. The antenna system of claim 7 wherein said surface regions of said arms include a third transverse surface region that is substantially orthogonal to said antenna axis, said second transverse surface region extending away from said antenna axis and said third transverse surface region extending inwardly toward said antenna axis.

9. The antenna system of claim 1 wherein said surface regions of said arms, when viewed in a cutting plane that includes said antenna axis, include first and second angularly disposed surface regions that extend outwardly from said antenna axis with said first and second angularly disposed surface regions having a common boundary edge.

10. A monopulse antenna system comprising a multiarm spiral antenna having at least three spiral arms arranged in a coaxial, interwound array so as to define an antenna axis, and a mode forming network having a predetermined feed impedance $Z_i$ coupled to a feed input of the antenna at the innermost ends of said arms, each of said arms being formed by an elongate strip of conductive material having a finite transverse dimension W forming surfaces that are opposed, proximate and generally parallel to surfaces on radially inward and radially outward adjacent arms such that the opposed, proximate and parallel surfaces of such adjacent arms form an angle A relative to the antenna axis and establish an inter-arm capacitance which in part determines the input impedance Z to said antenna, and pitch control means connected to said arms for varying said angle A, said arm surfaces being dimensioned and spaced in said opposed, proximate and generally parallel relationship and said pitch angle A being set by said pitch control so as to cause the input impedance Z of the antenna to assume a value that approaches said predetermined impedance $Z_i$ of said mode forming network.

11. The antenna system of claim 10, wherein said pitch control means comprises movable dielectric supports connected to said arms and means for controllably moving said dielectric supports.

12. The antenna system of claim 11, wherein said movable dielectric supports comprises elongate rack members arranged radially adjacent said arms, said arms being connected to said elongate rack members at spaced apart positions along the length of each said elongate rack member and wherein said means for controllably moving said dielectric supports comprise rack drive means for controllably displacing said rack members radially of said antenna axis.

13. A monopulse antenna system comprising a multi-arm spiral antenna having at least three spiral arms arranged in a coaxial, interwound array so as to define an antenna axis, and a mode forming network having a predetermined feed impedance $Z_i$ coupled to a feed input of the antenna at the innermost ends of said arms, each of said arms being a noncoplanar helix having a finite transverse surface region that extends outwardly away from said antenna axis, said finite transverse surface regions of adjacent arms of said spiral antenna being substantially parallel and spaced apart with one another to form an inter-arm capacitance which in part determines the input impedance Z to said antenna, said finite transverse surface regions being dimensioned and spaced apart from one another to establish said inter-arm capacitance substantially constant with radius from the innermost ends to the outermost ends of said arms and to cause the input impedance Z of the antenna to assume a value that approaches said predetermined impedance $Z_i$ of said mode forming network.

14. A monopulse antenna system comprising a multi-arm spiral antenna having at least three spiral arms arranged in a coaxial, interwound array so as to define an antenna axis, and a mode forming network having a predetermined feed impedance $Z_i$ coupled to a feed input of the antenna at the innermost ends of said arms, each of said arms having a finite transverse dimension forming surfaces that are opposed, proximate and generally parallel to surfaces on radially inward and radially outward adjacent arms such that the opposed, proximate and parallel surfaces of said adjacent arms form an inter-arm capacitance which in part determines the input impedance Z to said antenna, said arm surfaces being dimensioned and spaced in said opposed, proximate and generally parallel relationship such that said inter-arm capacitance is substantially constant with radius from the innermost ends to the outermost ends of said arms, and so as to cause the input impedance Z of the antenna to assume a value that approaches said predetermined impedance $Z_i$ of said mode forming network, said arms being dimensioned and arranged so that the transverse dimensions of said arm surfaces extend between a first set of arm edges adjacent one axial extent of the antenna and a second set of arm edges adjacent the opposed axial extent of the antenna, said first set of arm edges lying in a common plane normal to the antenna axis, and said second set of arm edges defining a generally conical profile, whereby said antenna has greater gain in an axial direction facing away from said first set of arm edges compared to the opposite axial direction.

* * * * *